United States Patent [19]

Lasto

[11] Patent Number: 4,880,358

[45] Date of Patent: Nov. 14, 1989

[54] ULTRA-HIGH VACUUM FORCE, LOW AIR CONSUMPTION PUMPS

[75] Inventor: Clifford S. Lasto, Woodbridge, Conn.

[73] Assignee: Air-Vac Engineering Company, Inc., Milford, Conn.

[21] Appl. No.: 209,288

[22] Filed: Jun. 20, 1988

[51] Int. Cl.[4] ..... F04F 5/00

[52] U.S. Cl. ..... 417/174; 417/191; 417/182

[58] Field of Search ..... 417/151, 163, 174, 182, 417/187, 189, 190, 165

[56] References Cited

U.S. PATENT DOCUMENTS

| | | | |
|---|---|---|---|
| 3,959,864 | 6/1976 | Tell | 417/179 |
| 4,158,528 | 6/1979 | Lasto et al. | 417/163 |
| 4,395,202 | 7/1983 | Tell | 417/169 |

*Primary Examiner*—William L. Freeh
*Assistant Examiner*—Robert N. Blackmon
*Attorney, Agent, or Firm*—Perman & Green

[57] ABSTRACT

Air-operated vacuum pump assemblies are disclosed which provide a maximum vacuum force and a large vacuum flow per volume of air consumption. The present venturi pump assemblies comprise one or more solid ejector housings each having a single longitudinal bore comprising two or more linear exit passage sections, each said passage section being larger than and spaced from the passage section exhausting thereinto. Vacuum chambers between the exit passage sections each communicate with a surface of the pump housing through transverse bores, to a common vacuum manifold through which vacuum flow can be drawn through each of the vacuum chambers of the linear exit passage sections for exhaust through the final downstream exit passage section. The linear bore includes a first venturi nozzle, and the housing includes a transverse bore including a smaller second venturi nozzle having a vacuum chamber which also communicates with the manifold and having a venturi passage which discharges into the first vacuum chamber of the first venturi nozzle.

4 Claims, 2 Drawing Sheets

ULTRA-HIGH VACUUM FORCE, LOW AIR CONSUMPTION PUMPS

BACKGROUND OF THE INVENTION

Air-operated vacuum pumps of the venturi type having unitary bored housings are well known in the art, and reference is made to U.S. Pat. No. 4,158,528 for its disclosure of a preferred embodiment of such a pump which provides an ultra-high vacuum force, equal to about 29.7" mercury, and an air consumption to vacuum flow ratio of about 3.2:1. In other words, such pumps provide the highest possible vacuum force, approaching a perfect vacuum force of 30" mercury, but consume 3.2 volumes of compressed air fed thereto to operate the pump for each volume of air withdrawn from a space or container being evacuated, i.e., vacuum flow.

Vacuum pumps which require a large volume of compressed air for the operation thereof necessitate the use of large capacity air compressors which are expensive, heavy and non-portable.

It is known to design air-operated vacuum pumps having unitary bored housings so as to improve the vacuum flow capacity thereof so that it exceeds the air consumption volume, but such known pumps are not capable of developing a vacuum force greater than about 10" mercury. Moreover, the highest possible vacuum flow air consumption ratio is only about 2.2:1 for pumps producing a vacuum force of about 4.1" Hg. Thus, the vacuum flow capacity is only improved at the expense of substantially reducing the vacuum force capability of the pump, and such pumps are unsatisfactory for use in evacuations requiring the development of a high vacuum force, i.e., greater than about 25" Hg.

It is also known to use electric vacuum pumps which have a large vacuum flow capability. However such pumps are large, heavy, expensive and noisy during operation. Moreover they have movable mechanical components which require maintenance and replacement.

SUMMARY OF THE INVENTION

The present invention relates to linear multi stage vacuum pumps having unitary bored housings and capable of developing a vacuum force of about 29" Hg or more, and having a vacuum flow/air consumption ratio of from about 2:1 to 4:1 or more. Such pumps can be operated at low air consumption to provide a relatively high vacuum flow, enabling the use of smaller, less expensive, portable air compressors which permit the evacuation apparatus to be moved to various use sites throughout a work place without the need for air hose extensions and/or a plurality of air pressure outlets installed throughout the work place, or they can be operated at higher air consumption rates to provide an extremely high vacuum flow, enabling the use of the present pumps as inexpensive, small, lightweight maintenance-free and relatively quiet replacements for electrical vacuum pumps.

In essence, the novel air operated vacuum pumps of the present invention comprise assemblies of two cooperating venturi pumps within a unitary bored housing, each venturi pump having a commonly-fed nozzle opening into a converging-diverging venturi section to create a vacuum chamber at the entrance of each venturi section of each pump. The first or linear venturi pump has an air consumption which is from 5 to 15 times greater than the air consumption of the second or transverse venturi pump and has a linear air flow bore comprising at least two and preferably three venturi sections, each having a vacuum chamber at the entrance thereof connected to a vacuum port. The second or transverse venturi pump has a smaller venturi section which exits to the first upstream vacuum chamber of the first venturi pump, to increase the vacuum flow of the first venturi pump, and has its vacuum chamber connected to a vacuum port. The present assemblies provide an exceptionally high vacuum force, 29" Hg or higher, and a high ratio of vacuum flow to air consumption, greater than about 2:1, by the permanent connection of the vacuum port of the second venturi pump to a vacuum manifold and by the valved connection of the two or more vacuum ports of the linear air flow bore of the first venturi pump to the same vacuum manifold. All of the vacuum ports are open to the manifold during initial evacuation, when the vacuum force therein is low, and the vacuum ports of the linear bore close in reverse sequence as the manifold vacuum force gradually increases until only the vacuum port of the second venturi pump is open to the manifold to develop a vacuum pressure of 29" Hg or more.

Thus, the linear air flow bore of the first venturi pump not only increases the vacuum force capability of the second venturi pump but also substantially increases the vacuum flow capacity of the assembly by providing a plurality of vacuum chambers along said bore, and automatic communication between said vacuum chambers and the vacuum manifold only when the vacuum flow requirements from the manifold are high, i.e., until a vacuum force of about 3" Hg is developed in the manifold, at which time the downstream vacuum chamber is closed to the manifold, etc., until all of the vacuum ports to the linear bore are closed and the manifold is only open to the vacuum chamber of the second venturi pump to develop a high vacuum force of about 29" Hg or more.

Each of the vacuum chambers of the linear bore, at least two and preferably three in number, is connected to a surface of the unitary housing by means of a transverse bore, the spaced ports of which communicate with a common vacuum manifold and are provided with vacuum sensitive valves which close in response to the development of a higher vacuum force within the manifold than within the vacuum chamber with which they communicate. Such structure provides at least two, and preferably three, vacuum flow outlets through the manifold and vacuum chambers to the linear air flow bore, each vacuum chamber sucking air through the manifold from the container being evacuated, in addition to the vacuum flow through the venturi section of the second venturi pump which also exits to the linear air flow bore, to increase the vacuum flow capacity of the pump to a point where the volume of vacuum flow is at least two and preferably three to four times the volume of air consumption, i.e., the volume of compressed air required to be introduced to the intake nozzle to operate the pump assembly. This enables the use of a small, inexpensive, portable air compressor to operate the pump assembly and yet provides an evacuation apparatus capable of developing a vacuum force of 29" Hg up to about 29.7" Hg. This is highly advantageous because it is expensive to provide large volumes of compressed air, and minimizing the air consumption reduces the cost of operating air compressors of all sizes.

The high vacuum force capability of the pump is due to the ability of the pump assembly to automatically seal off communication between the vacuum manifold and the vacuum chambers of the linear air flow bore of the larger venturi pump, in sequence, as the vacuum flow requirements decrease, i.e., as the volume of air being evacuated decreases and the negative pressure increases within the container being evacuated. Ultimately, the vacuum manifold is only in communication with the vacuum chamber of the second venturi pump, in which the maximum vacuum force is generated.

THE DRAWINGS

FIG. 1 is a lengthwise cross-section view of the venturi section of a multiple passage vacuum flow pump assembly according to one embodiment of the present invention, taken along the line 1—1 of FIG. 4;

FIG. 2 is a lengthwise cross-section view of the manifold section of a multiple passage vacuum flow pump assembly according to one embodiment of the present invention, taken along the line 2—2 of FIG. 4;

FIG. 3 is a lengthwise cross-section view illustrating the interconnection between the first venturi and linear air flow bore of its venturi sections and the vacuum manifold, taken along the line 3—3 of FIG. 4, and FIG. 4 is an end view of the vacuum flow pump assembly of FIGS. 1 to 3.

Figure 1:
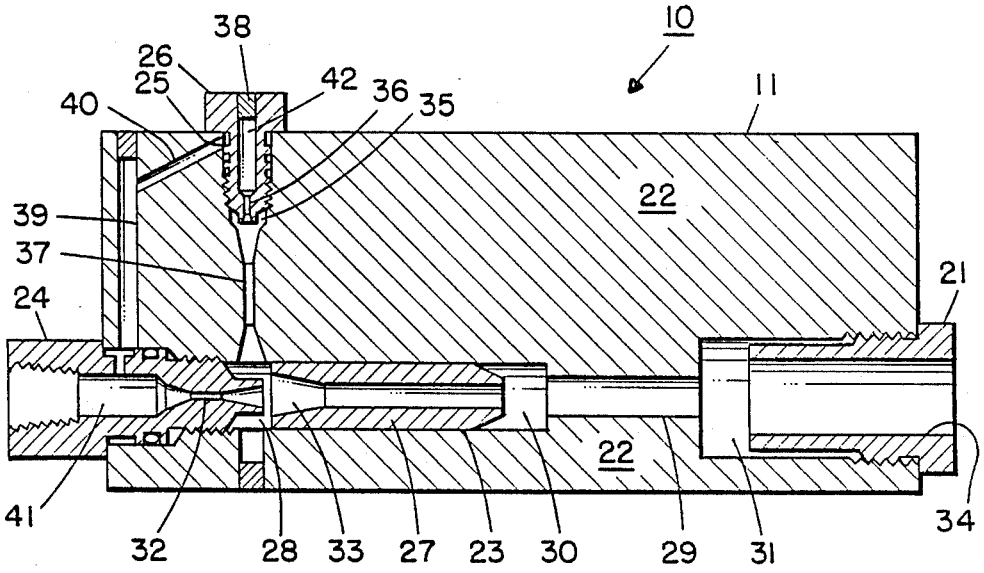
Referring to FIGS. 1 to 4, the pump assembly 10 thereof comprises a lower venturi nozzle unit 11, an upper vacuum manifold 12 and aninterposed gasket 13 provided with three spaced hinged flapper valve cuts 14 to 16, one associated with each of the vacuum ports 17 to 19 communicating between the venturi unit 11 and the vacuum manifold 12, as shown in FIG. 3. The venturi nozzle unit 11 is fastened through the gasket 13 to the manifold 12 by means of six screws 20 to provide air tight engagement with the manifold 12. The assembly 10 is preferably provided with a muffler such as a hollow end cap, preferably made or lined with sound-absorbent material or otherwise formed to reduce the noise of the air discharge, fastened to the air outlet end of the assembly and having a narrow exhaust opening spaced above the outlet bushing 21 for purposes of releasing exhaust air while muffling the sound of the exhaust air from the outlet bushing 21. The muffler shape can be changed, or deflectors added to force the exhaust air to travel a longer path in order to reduce velocity and thereby reduce noise.
Figure 2:
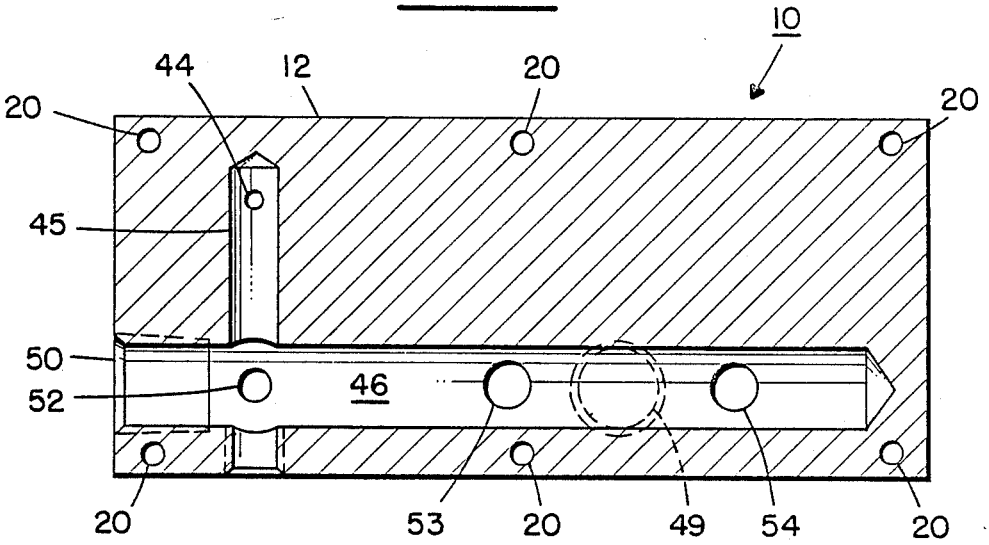
Figure 3:
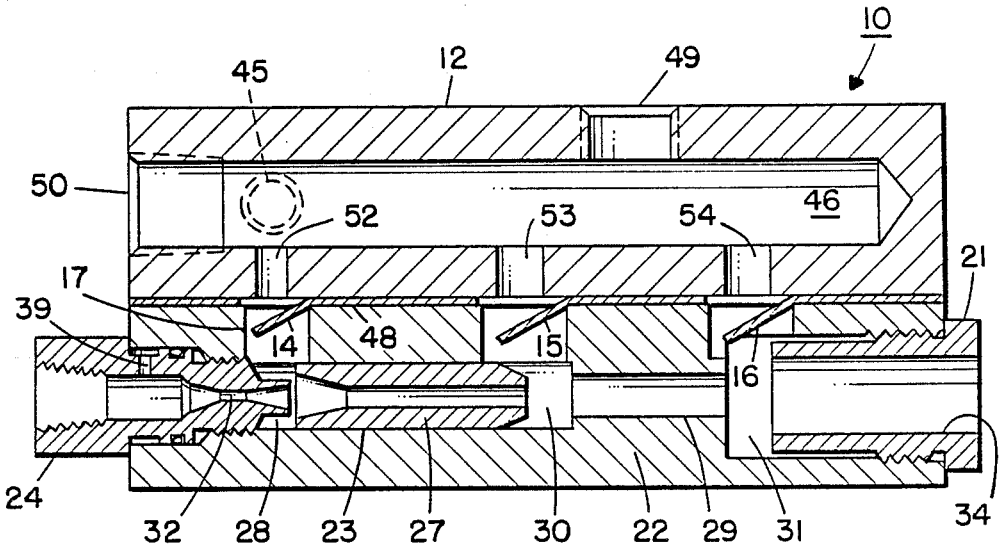

The venturi nozzle units 11 may be used individually, with a narrow manifold enclosing three aligned flapper valves such as 14, 15 and 16, as illustrated, or as assemblies of 2, 3, 4 or more units in side-by-side contact, each communicating with a common manifold of the corresponding width, including a common gasket having flapper valves for each of the vacuum ports 17 to 19 of each of the units 11. The venturi unit 11 comprises a rectangular housing 22, such as an aluminum block, provided with a linear stepped bore 23 which is wider at each end to threadably engage a first venturi inlet nozzle fitting 24 and an outlet bushing 21, and with a transverse stepped bore 25 which is wider at the inlet end to threadably engage a second, smaller venturi inlet nozzle fitting 26. The longitudinal bore 23 is reduced downstream of the inlet nozzle 24 to frictionally engage a first stage exit bushing 27 spaced by a vacuum chamber 28 from the end of the inlet nozzle fitting 24, and further reduced in diameter downstream to provide a second stage exit passage 29 which is spaced by a vacuum chamber 30 from the discharge end of the first stage exit bushing 27. Exit passage 29 opens to a final vacuum chamber 31 and into a third stage exit bushing 21 which exhausts the linear air flow.

As can be seen in FIG. 1, the inlet nozzle fitting 24 has a central air passage comprising a converging diverging venturi nozzle 32 having a diameter smaller than the remainder of the downstream linear air passage and therefore represents the area of greatest restriction of the air flow introduced thereto except for the second transverse venturi. Thus, air forced through venturi nozzle 32 exits at high speed through chamber 28 and into converging air passage 33 to create a high negative pressure or vacuum so that chamber 28 becomes a first vacuum chamber. As the air flow moves through the converging air passage 33 of the first stage exit bushing 27 which is larger in diameter than nozzle 32, the speed of the air flow decreases and the air flow exits through chamber 30 into exit passage 29 to create a medium negative pressure or vacuum, whereby chamber 30 becomes a second vacuum chamber. The air flow passes at a reduced speed through the second exit passage 29, which is larger in diameter than upstream air passage of the first stage bushing 27, and expands through chamber 31 into the larger diameter air passage 34 of the exit bushing 21 to form a smaller negative pressure or vacuum in the third vacuum chamber 31.

Thus, the inlet bushing 24, venturi nozzle 32 and linear bore comprising three exit passages, including the third stage exit bushing 21 constitute a first venturi pump capable, per se, of developing a vacuum force of about 26" to 28" Hg but having a ratio of air consumption to vacuum flow of about 2:1 to 3:1.

The nozzle pump assembly of the present invention integrates the first venturi pump with a second cooperative venturi pump, in the manner disclosed in U.S. Pat. No. 4,158,528, in order to provide a pump assembly capable of developing a higher vacuum force of about 29" Hg to 29.7" Hg, and connects the plurality of vacuum chambers 28, 30 and 31 of the linear bore 23 of the first vacuum pump as well as the vacuum chamber 35 of the transverse bore 25 of the second venturi pump to a common manifold, in order to provide a pump assembly which also has a low air consumption, i.e., a ratio of vacuum flow to air consumption of at least 2:1 and up to 4:1 or more.

Figure 4:
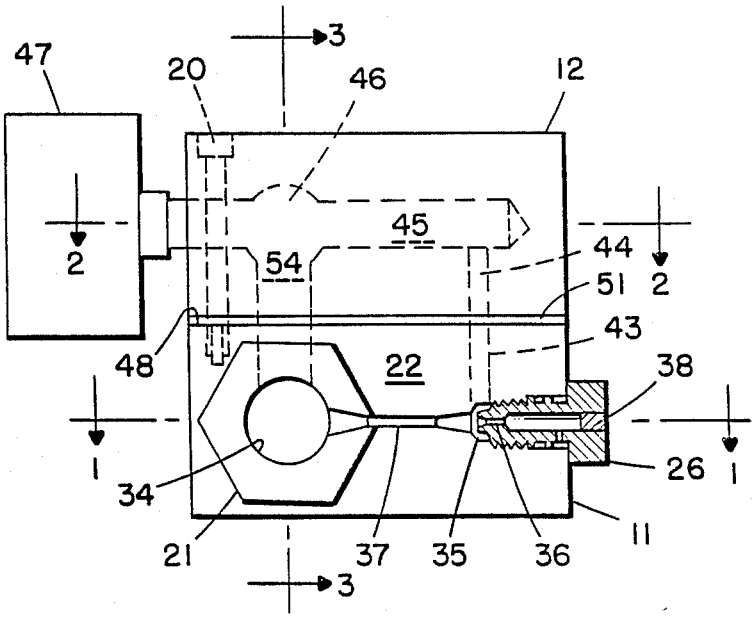

Referring to FIG. 1, the second venturi pump comprises the air inlet nozzle bushing 26 comprising a venturi nozzle 36 which is smaller than nozzle 32 of the first venturi pump and which exits through a vacuum chamber 35 into a converging-diverging exit stage 37 which discharges into the first vacuum chamber 28 opening into the first exit stage of the linear bore of the first venturi pump. The air inlet bushing 26 of the second venturi nozzle 36 is sealed with a linear plug 38, and interconnecting bores 39 and 40 are formed in the housing 22 to provide an inlet air connection between the air supply passage 41 of the first inlet nozzle fitting 24 and the air supply passage 42 of the second inlet nozzle fitting 26. Thus, operating fluid such as compressed air is supplied through a pressure hose threadably engaged within the first air inlet fitting 24 to linearly feed the first venturi nozzle 32 and to simultaneously feed the second venturi nozzle 36 through bores 39 and 40. The creation of a vacuum in chamber 28, at the discharge end of the exit stage 37 of the second venturi pump, caused by the operation of the first or linear vacuum pump, increases the speed of the air flow through the second venturi pump and thereby produces a very high vacuum force in the vacuum chamber 35 of the second vacuum pump. Said chamber 35 is opened to the vacuum manifold by means of a perpendicular bore 43 through the top surface of the venturi nozzle unit 11 which opens, through a hole in the manifold gasket 13, to a corresponding bore 44 up through the floor of the manifold 12 opening into a transverse manifold chamber bore 45 communicating with the linear manifold chamber bore 46, as shown by means of broken lines in FIG. 4. As further shown by FIG. 4, the transverse bore preferably is open to one side of the manifold 12 to threadably engage a vacuum gage 47 therein and provide a visual indication of the vacuum force existing within the manifold chambers 45 and 46.

As is well known to those skilled in the art, inlet nozzles of different minimum passage diameters and outlet nozzles of different maximum passage diameters will produce different air flow speeds at the same input pressures and therefore the venturi nozzle units 11 of the drawings are provided with a threaded inlet nozzle fitting 24 and a threaded output bushing 21 so that nozzles and bushing fittings of different air passage diameters may be substituted to produce air pump assemblies having the desired performance properties. The only requirement is that the air passage must increase in diameter from the inlet nozzle 32 through the linear passage to the outlet bushing 21, and the inlet nozzle 32 must have an air consumption which is from 5 to 15 times greater than that of the inlet nozzle 36 of the second, transverse venturi pump.

In order to provide the three vacuum chambers 28, 30 and 31 of each venturi unit 11 and the manifold bore 46, the solid rectangular housing 22 is drilled through a top surface 48 with three spaced and isolated vacuum passages 17, 18 and 19 each of which communicates with a single vacuum chamber, 28, 30 or 31, and opens to the top surface 48 to provide an individual, isolated port which permits access to the vacuum force exerted within said chamber, i.e., a high force within chamber 28, such as greater than about 27" Hg, a medium force within chamber 30, such as about 8" Hg. and/or a low force within chamber 31, such as about 3" Hg. The vacuum passage 17 to the maximum vacuum chamber 28 of the linear bore 23, and the chamber 28 itself, are smaller in volume than the other linear passages and chambers. However, the purpose of the three vacuum chambers 28, 30 and 31 and their isolated vacuum passages, 17, 18 and 19 is to provide a substantially increased vacuum flow through the linear air flow passage of the first venturi pump and also through the second venturi pump, thereby reducing the air consumption or volume of air which must be introduced through the inlet nozzles 24 and 26 to produce the desired vacuum flow within the manifold 12.

This is accomplished by providing the venturi unit 11 or a plurality of side by side venturi units with a vacuum manifold 12 having a vacuum chamber bore 46 which communicates with the ports of all of the vacuum passages 28, 30 and 31 and has a vacuum inlet port 49. In the illustrated embodiment, the manifold 12 comprises a rectangular solid member, such as of aluminum, provided with a longitudinal manifold bore 46 and one transverse bore 45 which opens into bore 46 and provides a vacuum gage port to which a vacuum 47 gage can be threadably engaged to provide a reading of the vacuum force within the manifold. The end of the longitudinal bore 46 is provided with a sealing plug 50 or may be used as the vacuum inlet, in which case inlet 49 is plugged. The undersurface 51 of the manifold 12 is provided with four spaced manifold bores 44, 52, 53 and 54 opening into the manifold chamber bores 45 and 46, bores 52, 53 and 54 being aligned in location over the chamber passages 17, 18 and 19 so as to open each of the vacuum chambers 28, 30 and 31 of the linear bore of the first venturi pump to the vacuum chamber bore 46 of the manifold 12, and bore 44 being aligned in location over chamber passage 43 of the second venturi pump to open it to the transverse bore 45 of the manifold 12.

In order to protect the manifold 12, provide maximum vacuum flow during evacuation and provide the highest possible vacuum force within the evacuated compartment, the assembly of the drawings comprises a flapper valve gasket 13 which seals the manifold 12 to each venturi unit 11 except in the areas of the ports to the vacuum chamber passages 17, 18, 19 and 43 at the top surface 48 of each unit 11. Gasket 13 is provided with a permanent opening over the passage 43 leading to the chamber 35 of the second venturi pump so that the latter is open to the manifold chamber bores 44, 45 and 46 at all times. Gasket 13 is provided with spaced flapper valves 14, 15 and 16 one for each chamber passage 52, 53 and 54 respectively, in order to automatically close communication between manifold bore 46 and each passage 54 when the manifold vacuum force increases to a minimum vacuum force, such as about 3" Hg., and then automatically close communication between manifold bore 46 and each passage 53 when the manifold vacuum force increases to a medium vacuum force, such as about 8" Hg and finally to automatically close communication between manifold bore 46 and each passage 52 when the manifold vacuum increases to a larger value of about 27" Hg. Above this vacuum force of about 27" Hg nearly all of the air has already been evacuated from a closed container so that the vacuum flow is very small. The closing of the linear vacuum chambers of the first venturi pump to the manifold, after evacuation is substantially completed, enables the present venturi pump assembly to function with maximum effectiveness of the venturi nozzle 36 of the second venturi pump, which is the smallest nozzle of the assembly, to build up a maximum vacuum force greater than 29" Hg and generally up to about 29.7" Hg.

The flapper valves 14, 15 and 16 are hinged tabs cut into the gasket 13, flexed downward or open by the vacuum flow until the vacuum force within the manifold chamber 46 increases to a value greater than the vacuum force within the vacuum chamber 19, causing downstream valve 16 to be drawn up to closed position, and increases further to a value greater than the vacuum force within the vacuum chamber 18, causing the next upstream valve 15 to be drawn up to closed position, and increases yet further to a vacuum force greater than the value within the upstream vacuum chamber 17 of the linear bore 23, causing the upstream valve 14 to close. The flapper valves 14, 15 and 16 are large enough and strong enough to seat over and seal the inlet ports of the manifold passages 52, 53 and 54 under the effects of a high manifold vacuum force as exerted by the remaining connection between the manifold chamber 45 and the vacuum chamber 35 of the second pump.

As is apparent, the manifold vacuum port 49 (or 50) is designed to be connected to a sealed container to be evacuated, such as by means of a suitable vacuum hose, and the inlet bushing 24 is designed to be connected to an air compressor, such as by means of an air pressure hose, the compressor being adjustable to deliver air at a predetermined pressure, such as 80 psi, and being provided with a regulating shut off valve. When the valve is opened to admit pressurized air at a desired air flow rate, a vacuum force and a large vacuum flow are initiated. All of the chambers 17, 18, 19 and 35 are open to the vacuum manifold chamber 45–46 and to the container being evacuated and therefore the vacuum flow or air being evacuated from the container is caused to exit the manifold through the manifold passages 52, 53, 54 and 44, and through the chamber passages 17, 18, 19 and 43 by the vacuum forces exerted by the chambers 28, 30, 31 and 35. This substantially increases the dimensions of the vacuum flow escape route, the total vacuum flow capacity, while maintaining a high vacuum force potential in the vacuum chamber 35 of the second venturi pump. The result is a very high vacuum flow, six or more times greater than is possible in the absence of the linear bore vacuum chambers 17, 18 and 19 and their vacuum passages 52, 53 and 54 to the manifold chamber 46. In other words, a single flow vacuum pump assembly similar to that of the present drawings but having the flapper valves 14, 15 and 16 sealed closed will provide an air consumption to vacuum flow ratio of over 3:1, whereas the present multiple passage vacuum flow pumps, having two or more vacuum flow escape routes for the evacuation, provide an air consumption to vacuum flow ratio of from about 1:2 to 1:4. Thus the same air consumption can be used to provide a higher vacuum flow and hasten the evacuation or, more importantly, the air consumption can be reduced to about one sixth and yet provide the same vacuum flow. This enables the use of smaller, less expensive and more portable air compressors in cases where a reduced air consumption is more important than an increased vacuum flow.

When evacuation is nearly completed, the vacuum force builds quickly within the container and manifold chambers 45 and 46, causing valve 16 to close when the manifold vacuum reaches about 2–3" Hg, then causing valve 15 to close when the manifold vacuum reaches about 8" Hg, and finally causing valve 14 to close when the manifold vacuum reaches about 27" Hg. This converts the pump assembly to one having a single vacuum flow path through the second venturi pump via chambers 35, passages 44 and 43 and manifold chambers 45 and 46 from the manifold inlet 49. However, the vacuum force exerted is high, in the area of 29"–29.7" Hg. As noted above, different nozzle fixtures 24 can be interchanged in order to provide different maximum vacuum forces and vacuum flow in chambers 28, 30, and 31 depending upon the requirements of the operations, and different exit bushings 21 having different tapers and larger or smaller diameter exit passages 34 can also be interchanged in order to provide different vacuum forces in the final downstream vacuum chamber 31 of the linear bore 23.

It will also be apparent that the dimensions of the venturi passage 37 of the second venturi pump and of the linear ejection passage, comprising exit bushing 27, exit passage 29 and exit bushing 21 can be varied to vary the speed of the air flow therethrough and the vacuum forces developed within chambers 35, 28, 30 and 31 and the dimensions of these chambers can also be varied for the same purpose. However the purpose of the design of the present pumps is to develop the highest possible vacuum force with the smallest possible ratio of air consumption to vacuum flow. This requires that nozzle 36 of the second or transverse venturi must have an air flow consumption which is 5 to 15 times smaller than the air flow consumption of nozzle 32 of the first venturi, and that the throats of the first stage exit bushing 27, the second stage exit passage 29 and the exit bushing 21 must be larger than nozzle 32 and increase in the linear direction. The purpose of this design is to reach a vacuum of 29.7" Hg.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. A multi stage ejector assembly comprising a solid elongate housing, a longitudinal cylindrical bore through said housing comprising a first venturi pump having a first converging-diverging venturi inlet nozzle opening through a first vacuum chamber in said cylindrical bore into the converging entrance of a first exit passage which opens through a second vacuum chamber into a second exit passage communicating with an outlet end of the cylindrical bore, first and second transverse bores inwardly from a side of the housing and each opening into said cylindrical bore at said first vacuum chamber, and a third transverse bore inwardly from a side of the housing and opening into said cylindrical bore at said second vacuum chamber, said first transverse bore comprising a second venturi pump having a second venturi inlet nozzle having an air flow consumption which is from about 5 to 15 times smaller than the air flow consumption of said first venturi inlet nozzle, said second venturi inlet nozzle opening through a maximum vacuum chamber into a converging-diverging venturi exit passage which opens into said cylindrical bore at the first vacuum chamber of the first venturi pump adjacent said converging entrance of the first exit passage, a fourth transverse bore inwardly from a side of the housing and opening into the vacuum chamber of said second venturi pump, air-inlet means communicating with the venturi inlet nozzles of both said first and second venturi pumps, a vacuum manifold connected to said housing and having a vacuum chamber communicating with each of said second, third and fourth transverse bores and having a vacuum flow inlet designed to be connected to a container to be evacuated, and independent vacuum-sensitive valve means supported between said vacuum manifold and each of said second and third transverse bores to sequentially close communication between the first and second vacuum chambers of the longitudinal bore and the chamber of the manifold when the vacuum force within the manifold increases to a value greater than the vacuum force within said first and second vacuum chambers, the chamber of the manifold being open to the fourth transverse fore and to the vacuum chamber of the second venturi pump at all times in order to develop a high vacuum force in the manifold chamber, and the chamber of the manifold being open to the second and third transverse bores only when the vacuum force within the manifold chamber is low, to provide a high vacuum flow through the manifold chamber until the vacuum force therewithin increases.

2. An ejector assembly according to claim 1 in which the second exit passage of the longitudinal cylindrical bore communicates with said outlet end of the bore through a third vacuum chamber and a third exit passage to the outlet end of the bore, and said housing comprises a fifth transverse bore, inwardly from a side thereof, and opening between said third vacuum chamber and said manifold chamber to provide access to a minimum vacuum force developed within said third chamber as a result of compressed air passed through said longitudinal bore, and a said vacuum-sensitive valve means closing communication between said manifold chamber and said third vacuum chamber when the vacuum force within the former is greater than that within the latter.

3. An ejector assembly according to claim 1 for providing a higher volume of vacuum flow than air consumption and capable of developing a high vacuum force in excess of about 29" Hg., comprising a said assembly further including a sealing gasket mounted between said vacuum manifold and said ejector housing, said gasket including an air passage in the area overlying the fourth transverse bore opening into the maximum vacuum chamber of said second venturi pump, and including hinged tabs forming vacuum-sensitive flapper valves overlying the second and third transverse bores opening into the first and second vacuum chambers of the longitudinal bore of said first vacuum pump, whereby only said maximum vacuum chamber of the second venturi nozzle is open to the vacuum manifold compartment at all times, said flapper valves being supported in position to automatically seal the communication between each of said second and third transverse bores to said manifold chamber whenever the vacuum force within said vacuum manifold chamber exceeds the vacuum force within each said first and second vacuum chamber, whereby at lower vacuum forces within the manifold chamber the vacuum flow can exit therefrom through said first and second vacuum chambers, to provide increased vacuum flow, and when the vacuum forces within the manifold chamber increase to a value greater than within each first and second vacuum chamber each flapper valve closes to channel the vacuum flow exit to the maximum vacuum chamber of the second venturi pump, permitting the development of a high-vacuum force in excess of about 29" Hg.

4. An ejector assembly according to claim 3 comprising a plurality of said ejector housings, side by side, and a unitary vacuum manifold attached to each of said ejector housings and having a vacuum compartment which is in communication with the second, third and fourth transverse bores and each of the vacuum chambers of each of the housings, and having a vacuum flow inlet port for communicating said vacuum compartment and each of the vacuum chambers of each of said housings with a container to be evacuated.

* * * * *